US005112007A

United States Patent [19]

Büchele-Buecher

[11] Patent Number: 5,112,007

[45] Date of Patent: May 12, 1992

[54] MISSILE STEERING DEVICE

[75] Inventor: Sigfrid Büchele-Buecher, Meerbusch, Fed. Rep. of Germany

[73] Assignee: Rheinmetall GmbH, Düsseldorf, Fed. Rep. of Germany

[21] Appl. No.: 672,562

[22] Filed: Mar. 20, 1991

[30] Foreign Application Priority Data

Apr. 14, 1990 [DE] Fed. Rep. of Germany ..... 4012153

[51] Int. Cl.[5] ..... F42B 10/66

[52] U.S. Cl. ..... 244/3.22; 239/265.23

[58] Field of Search ..... 244/3.22; 239/265.17, 239/265.23

[56] References Cited

U.S. PATENT DOCUMENTS

| | | | |
|---|---|---|---|
| 3,740,003 | 6/1973 | Ayre et al. | 244/3.22 |
| 4,408,735 | 10/1983 | Metz | 244/3.22 |
| 4,413,795 | 11/1983 | Ryan | 244/3.22 |
| 4,803,925 | 2/1989 | Buchele-Buecher | 244/3.22 |

FOREIGN PATENT DOCUMENTS

| | | |
|---|---|---|
| 8299 | 2/1985 | Austria . |
| 3632553C1 | 12/1987 | Fed. Rep. of Germany . |
| 2846372C3 | 3/1990 | Fed. Rep. of Germany . |

*Primary Examiner*—Charles T. Jordan

*Attorney, Agent, or Firm*—Spencer, Frank & Schneider

[57] ABSTRACT

To improve the steering of autonomous missiles with respect to great thrusts and a large number of guide pulses, preferably in a caliber range of less than 100 mm, fluidic wall jet elements are provided in branching conduits which are connected to radially directed steering nozzles and which are disposed in a plurality, for example, four, of control discs arranged one behind the other within the missile. The respective fluidic wall jet elements permit a sudden change in direction in a respective branching conduit of a hot gas stream generated by a gas generator. This makes it possible to generate, for example, a change in the direction of the gas stream from one steering nozzle to an oppositely disposed steering nozzle. A plurality of miniature flame capsules or compressed gas cartridges are arranged in a space saving manner in at least one disc-shaped recess as the actuators for the fluidic wall jet elements. The actuators ensure individual or joint actuation of steering nozzles arranged, for example, at 90° offsets on the missile circumference. Additionally, it becomes possible to perform variable time steering processes, particularly those with extremely short response times of less than 1 ms.

7 Claims, 2 Drawing Sheets

FIG.1
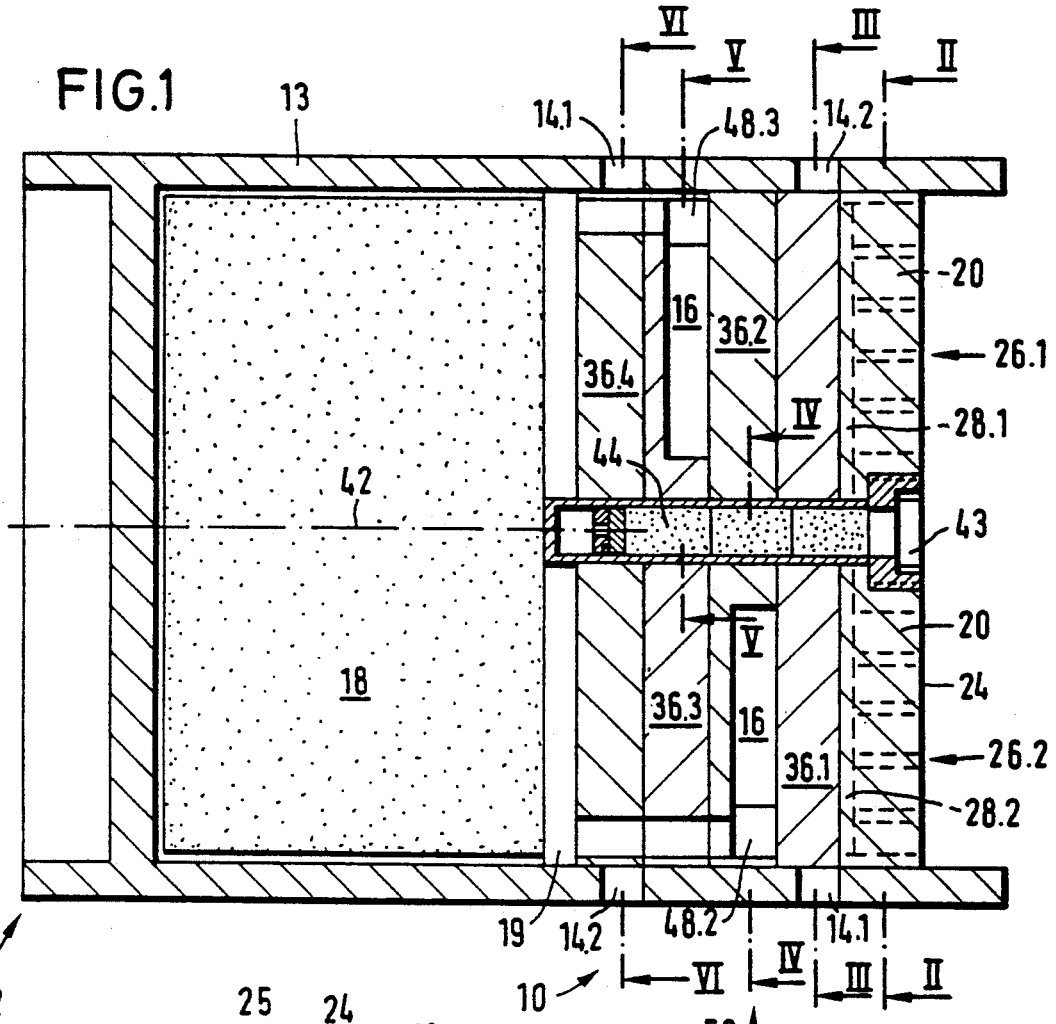
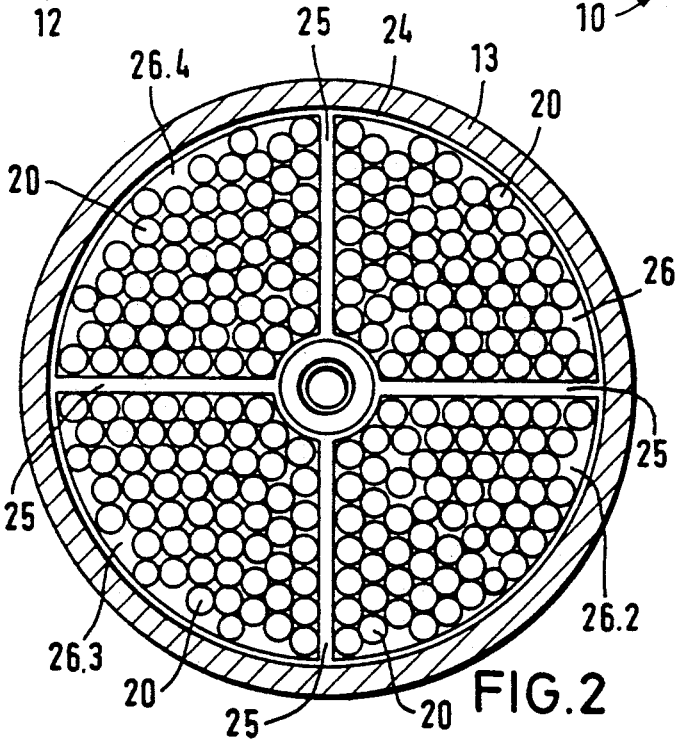
FIG.2
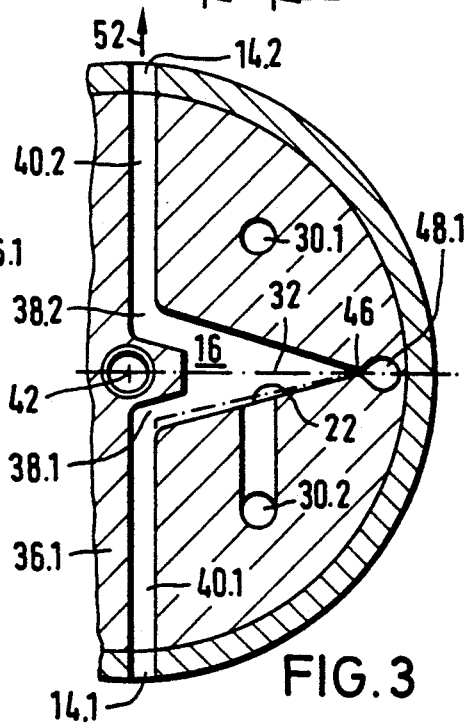
FIG.3

MISSILE STEERING DEVICE

BACKGROUND OF THE INVENTION

The present invention relates to a missile steering device including a plurality of radially oriented steering nozzles disposed about the missile circumference, with each nozzle being connected via a branching conduit with a gas generator which, in order to generate a steering pulse, produces a high pressure gas stream whose direction is changed within the branching conduit by a fluidic wall jet element in the branching conduit and selectively actuated by an actuator.

A missile with such a steering device is disclosed in German Patent No. 2,846,372. This missile is, for example, a projectile and is provided with a supersonic diffuser so that such a projectile has a comparatively large caliber diameter of more than 150 mm. Therefore, for example, a group of radially oriented steering or control nozzles are arranged in the circumferential direction of a sector of the projectile shell for correction and guidance of its flight. This permits utilization of the supersonic wave which results from the transverse forces of the shock wave and flows around the projectile. In order to obtain a guidance pulse, it is necessary to briefly introduce into the steering nozzles the high pressure gases generated by a compressed gas source. To guide the high pressure gases into the steering nozzles, a fluidic element operating according to the Coanda effect is disposed within a branch conduit.

Electrodes are provided in oppositely disposed wall recesses within the branch conduit in order to change the flow direction. However, these electrodes require a large amount of energy for the necessary strong electrical discharge. Moreover, the making available of such large amounts of electrical energy requires a considerable amount of space which, particularly in missiles of a caliber less than 100 mm, is not available.

It is also known to produce the flow direction change by supplying a gas or a liquid. For example, known electromechanically operating switching valves are employed for this purpose. However, such switching valves are also not suitable to guide a fast flying missile, for example, a rocket, controllable submunition, or the final phase of a projectile, because of the large amount of space they require and their too slow operation. Another drawback is the possibly insufficient firing resistance of such movable actuators.

SUMMARY OF THE INVENTION

In contrast, it is an object of the present invention to improve the above-described steering device in such a way that a directed, rapid direction change of the gas stream is possible for the guidance of fast flying missiles while requiring little energy and space.

This object is accomplished by the present invention by a missile steering device disposed within a shell of a missile and comprising: a plurality of radially oriented steering nozzles disposed along the circumference of the shell of the missile; a gas generator for producing a high pressure gas stream; at least one branching conduit connecting at least a pair of the steering nozzles with an output of the gas generator; and means for generating a steering pulse including at least one fluidic wall jet element disposed within a wall of each branching conduit for changing the flow direction of the high pressure gas stream within the branching conduit when actuated, and an actuator for each wall jet element; and wherein each fluidic wall jet element has an associated respective actuator in the form of at least one of miniature flame capsules and compressed gas cartridges.

According to a feature of the invention, the miniature flame capsules or compressed gas cartridges are all disposed in at least one disc-shaped recess within the missile shell, the receptacle is divided into a number of chambers, corresponding to the number of fluidic wall jet elements, which are separated by partitions, each chamber contains a plurality of miniature flame capsules or compressed gas cartridges which are combined into a respectively separate group, and each chamber includes a respective ante-chamber which is connected via a respective control line with a respective fluidic wall jet element.

According to the preferred embodiment of the invention, each branching conduit is associated with a respective fluidic wall jet element and is disposed on a cross-sectional axis of symmetry of a respective control disc disposed within the missile shell, each branching conduit includes two outlets with associated discharge channels which are connected respectively with two steering nozzles arranged opposite one another on the circumference of the missile shell, an even number e.g., four, of the control discs, associated in pairs, are provided and arranged one behind the other within the shell, with the fluidic wall jet elements of each pair of control discs being disposed diametrally opposite one another relative to the longitudinal axis of the missile. With four control discs arranged one behind the other within the shell, the respective fluidic wall jet elements are offset by 90° relative to one another.

The use of miniature flame capsules or compressed gas cartridges as actuators for each fluidic wall jet element permits, in an advantageous manner, an extremely short response period of $<1$ ms for the reversal of the gas stream. This measure considerably improves the guidance behavior particularly of fast flying missiles. By arranging the flame capsules or compressed gas cartridges in large numbers, the number of guidance pulses can be increased and varied in a simple manner as well as adapted to the flight profile.

In particular, the arrangement of the actuators within a disc-shaped recess or receptacle, and the arrangement of each fluidic wall element on a control disc, results in a space saving arrangement within fast flying missiles which preferably have a small caliber of $<100$ mm. The use of flame capsules and compressed gas cartridges avoids movable components and their concomitant drawbacks. Operation of the steering system is ensured even if there are malfunctions, because each flame capsule and compressed gas cartridge is redundant in itself. Commercially available flame capsules and compressed gas cartridges have a space saving diameter from 3 to 7 mm and a length from 5 to 9 mm.

In each control disc, the actuators cause a flow reversal or direction change within the respective branching conduit by switching the high pressure gas stream from the one side or wall of the branching conduit to the other side. Thus the gas is conducted from a first radially oriented steering nozzle to a second steering nozzle oriented in the opposite direction. With an arrangement of preferably four control discs in which the wall jet elements are each offset relative to one another by 90°, the gas stream flows, if the flow is monostable, out of a steering nozzle which is likewise offset by 90° so that no effective guidance pulse is generated.

If there is a flow reversal within only one control disc, a sudden guidance pulse flowing from two gas streams oriented in the same direction can be utilized. If there is a simultaneous flow reversal within two 90° offset steering nozzles, the guidance pulse from four gas streams at 45° can be effectively utilized immediately and advantageously.

The steering device will be described below in greater detail with reference to the below listed drawing figures.

BRIEF DESCRIPTION OF THE DRAWINGS

FIG. 1 is a schematic longitudinal sectional view of a missile steering device according to the invention.

FIG. 2 is a sectional view of the actuators and chambers for the steering device as seen along a line marked II—II in FIG. 1.

FIGS. 3 to 6 show different installed positions of the four control discs of FIG. 1, with FIG. 3 being a partial cross-sectional view in the direction marked III—III in FIG. 1, FIG. 4 being a partial cross-sectional view in the direction marked IV—IV in FIG. 1, FIG. 5 being a partial cross-sectional view in the direction marked V—V in FIG. 1, and FIG. 6 being a partial cross-sectional view in the direction marked VI—VI in FIG. 1.

DETAILED DESCRIPTION OF THE PREFERRED EMBODIMENT

Figure 4:
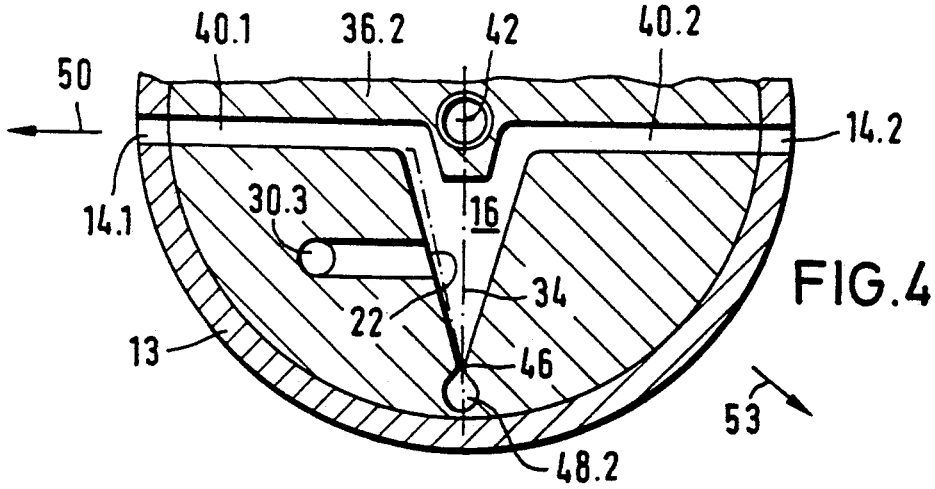

FIG. 1 illustrates a portion of the length region of a missile 12 (not shown in detail) and the steering device 10 disposed therein. A missile shell or housing 13 encloses the steering device 10 which essentially comprises three major components, that is, a gas generator 18 provided with a propellant, a plurality of control discs, for example, four control discs 36.1, 36.2, 36.3 and 36.4, forming respective fluidic stages, as well as a disc-shaped receptacle or recess 24 accommodating a number of actuators 20.

Control discs 36.1 to 36.4, which are also shown in FIGS. 3 to 6, respectively, each include, on an axis of symmetry 32 (FIGS. 3 and 6) or 34 (FIGS. 4 and 5), a respective branching conduit 16. Each respective branching conduit 16 of each disc 36.1-36.4 has a respective inlet 46 which is connected via a separate gas channel 48.1, 48.2, 48.3 or 48.4, respectively, with the gas generator 18 so as to supply the high pressure gas stream generated by gas generator 18 to the respective conduits 16. As shown the respective inlets 46 are disposed adjacent the periphery of the respective disc 36.1-36.4 so that the gas stream flows radially inwardly.

Each branching conduit 16 has two outputs 38.1, 38.2 whose respective discharge channels 40.1, 40.2 are connected with respective steering or control nozzles 14.1, 14.2 which are arranged opposite one another on the circumference of missile shell 13.

Each branching conduit 16 includes a fluidic wall jet element 22 on the same side or wall. Since, for example, all four control discs 36.1 to 36.4 shown in FIG. 1 are arranged one behind the other, with the fluidic wall jet elements 22, as shown in FIGS. 3 to 6, taking up positions that are offset by 90° relative to one another, and if there is no actuating signal for the fluidic elements 22, the high pressure gas stream from gas generator 18 will be caused, due to the asymmetric configuration of the branching conduits 16, to always be placed against the wall of the conduit 16 containing the respective fluidic element 22 in a monostable manner, and to flow out of nozzle outlet 14.1. In this arrangement of fluidic elements 22, the four control discs 36.1 to 36.4 normally permit the hot gases to flow out in the four compass directions without an effective steering force.

To generate a steering pulse, for example in a direction marked 50 in FIG. 4, it is necessary to redirect the hot gas stream within a branching conduit 16 so that the gas no longer flows to radial steering nozzle 14.1, but rather flows to the oppositely disposed radial steering nozzle 14.2. In order to redirect the flow of gas, the respective fluidic wall jet element 22 must be actuated by an actuator. In this missile 12, miniature flame capsules or compressed gas cartridges 20 are employed as actuators.

FIGS. 1 and 2 illustrate the arrangement of miniature flame capsules or compressed gas cartridges 20 in a disc-shaped recess or receptacle 24 disposed within missile shell 13 adjacent its rear or tail. Receptacle 24 includes a number of chambers 26.1, 26.2, 26.3, 26.4 corresponding to the number of fluidic wall jet elements 22, i.e., four in the illustrated embodiment. These chambers 26.1-26.4 are separated from one another by a plurality of partitions 25, and each accommodates a plurality of miniature flame capsules or compressed gas cartridges 20 in separate blocks or groups.

Each chamber 26.1 to 26.4 includes an ante-chamber 28.1, 28.2, 28.3, 28.4, respectively, adjacent to the outer or rear control disc 36.1. Each ante-chamber 28.1-28.4 is connected with a respective fluidic wall jet element 22 by a separate control line 30.1, 30.2, 30.3 or 30.4 shown in FIGS. 3 to 6. Each control line 30.1-30.4 passes through each of the discs 36.1-36.4 disposed between the associated ante-chamber 28.1-28.4 and the respective fluidic element 22 of the associated control disc.

Partitions 25 provide a gas tight termination between the groups or blocks of individual actuators 20.

After firing of an actuator 20 disposed, for example, in chamber 26.1, pressure builds up in the corresponding ante-chamber 28.1 so that, via the associated line 30.1, the associated fluidic wall jet element 22 is able to effect a change in the flow of gas in the conduit 16 of control disc 36.3 (FIG. 3). In the illustrated example, the gas stream of control disc 36.3 no flows radially out of the associated steering nozzle 14.2 so that missile 12 receives a steering pulse in the opposite direction 50. As soon as, for example, one or several flame capsules 20 have been burnt, the gas stream switches back to the other side within the branching conduit 16 to terminate this steering process.

The actuation and firing of actuators 20 is controlled by an electronic unit (not shown) which, after the pulse duration required for guidance, automatically switches through the corresponding actuators 20 in the respective chambers 26.1 to 26.4. In this way, already consumed flame capsules 20 are prevented from receiving another firing pulse.

Figure 5:
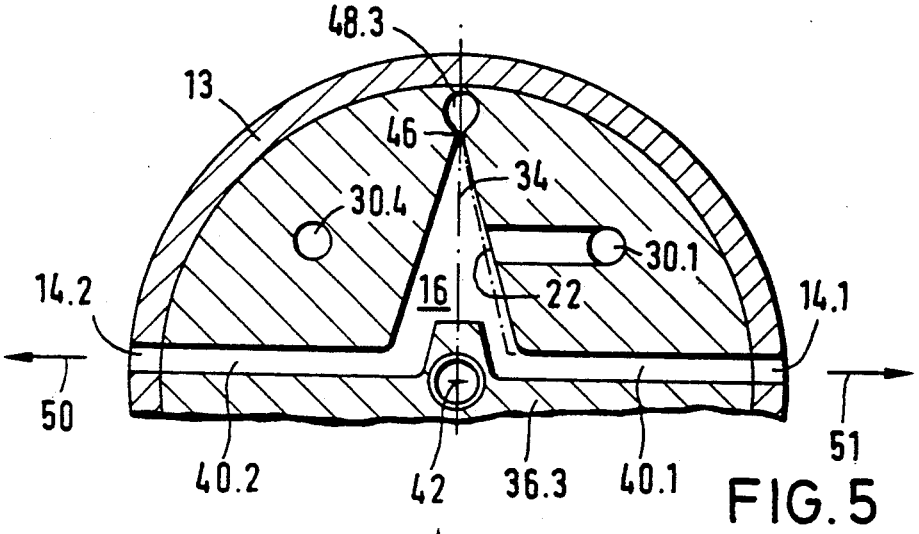
Figure 6:
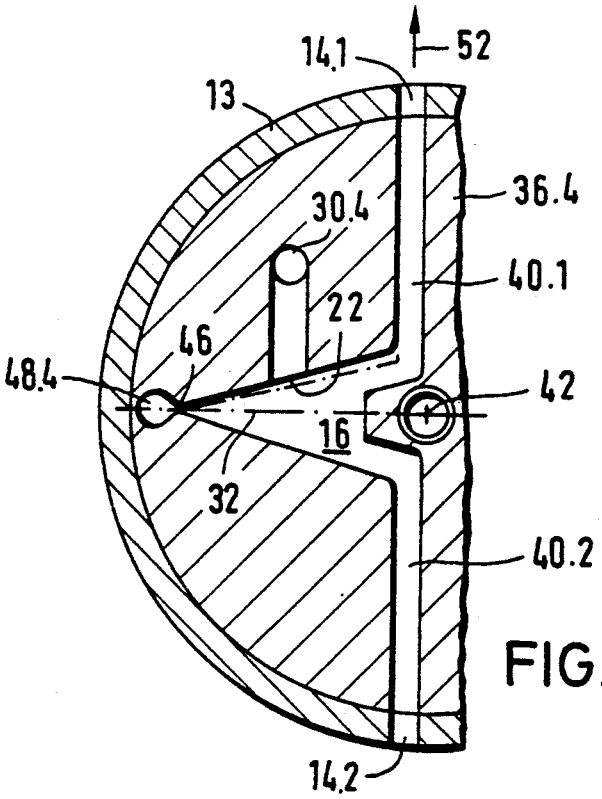

The electronic unit also permits simultaneous firing of several actuators 20 in different chambers. If, for example, the actuators 20 of chambers 26.1 and 26.2 are fired simultaneously, the fluidic wall jet elements 22 shown in FIGS. 3 and 5 are charged with pressure via control lines 30.1 to 30.2 in a minimum response time of less than 1 ms so that generator gases suddenly flow in the same direction 52 out of steering nozzle 14.2 of control disc 36.1 (FIG. 3) and out of steering nozzle 14.1 of control disc 36.4 (FIG. 6), and generator gases suddenly flow in the same direction 50 out of steering nozzle 14.1 of control disc 36.2 (FIG. 4) and out of steering nozzle 14.2 of control disc 36.3 (FIG. 5). This generates, for example, a sum steering pulse at 45° in direction 53 which results from the maximum mass flow of all four steering nozzles. By adding further control discs, the steering pulse can be made stronger, but care must be taken that an even number of control discs 36 are added and the control discs are arranged in pairs so that the fluidic wall jet elements 22 of the pair are arranged diametrally opposite one another relative to the longitudinal axis 42 of the missile.

Depending on the particular requirements, each flame capsule or compressed gas cartridge 20 may generate a high pressure gas for charging a fluidic wall jet element 22 over a time period between 2 ms and 10 ms. In order to generate a defined flight profile, the number of disc-shaped receptacles 24 for the actuators 20 may be increased in a manner not shown.

Gas generator 18 is fired by means of a primer 43 via an ignition charge 44, with control discs 36.1 to 36.4 and receptacle 24 centrally accommodating the ignition charge 44 for gas generator 18 which is in the form of a propellant charge disposed in a combustion chamber 19. The hot generator gases then travel from combustion chamber 19 into separate gas channels 48.1 to 48.4, with each gas channel being disposed in the control disc or discs 36.1–36.4 disposed between the inner gas generator 18 and associated branching conduit 16.

The invention now being fully described, it will be apparent to one of ordinary skill in the art that any changes and modifications can be made thereto without departing from the spirit or scope of the invention as set forth herein.

What is claimed is:

1. In a missile steering device disposed within a shell of a missile and comprising: a plurality of radially oriented steering nozzles disposed along the circumference of the shell of the missile; a gas generator for producing a high pressure gas stream; at least one branching conduit each connecting at least a pair of steering nozzles with an output of said gas generator; and means for generating a steering pulse including at least one fluidic wall jet element disposed within a wall of each respective said branching conduit for changing the flow direction of the high pressure gas stream within the branching conduit when actuated, and an associated respective actuator, in the form of at least one of miniature flame capsules and compressed gas cartridges, for each said fluidic wall jet element; the improvement wherein:

(a) said miniature flame capsules or compressed gas cartridges are all disposed in at least one disc-shaped recess within said missile shell;

(b) said receptacle is divided into a number of chambers corresponding to the number of said fluidic wall jet elements, with said chambers being separated by partitions;

(c) each said chamber contains a plurality of said miniature flame capsules or compressed gas cartridges which are combined into a respectively separate group; and (d) each said chamber includes a respective antechamber which is connected via a respective control line with a respective said fluidic wall jet element.

2. A steering device as defined in claim 1 wherein:

(a) each said branching conduit is associated with a respective said fluidic wall jet element and is disposed on a cross-sectional axis of symmetry of a respective control disc disposed within said missile shell; and (b) each said branching conduit includes two outlets with associated discharge channels which are connected respectively with two of said steering nozzles arranged opposite one another on said circumference of said missile shell.

3. A steering device as defined in claim 2 comprising an even number of said control discs, associated in pairs, arranged one behind the other within said shell, with said fluidic wall jet elements of each said pair of said control discs being disposed diametrally opposite one another relative to the longitudinal axis of the missile.

4. A steering device as defined in claim 3 wherein four of said control discs are arranged one behind the other within said shell, with the respective said fluidic wall jet elements each being offset by 90° relative to one another.

5. A steering device as defined in claim 2 wherein: said gas generator comprises a propellant charge; said receptacle is disposed at a rear end of said missile shell; said control discs are disposed between said receptacle and said propellant charge; and an ignition charge for said propellant charge extends centrally through said receptacle and said control discs to said propellant charge.

6. A steering device as defined in claim 5 wherein each said branching conduit has an inlet which is connected with said gas generator via a separate gas channel, with each said gas channel extending through each said control disc disposed between said gas generator and the associated said branching conduit.

7. A steering device as defined in claim 2 wherein each said branching conduit has a respective inlet which is disposed adjacent the periphery of a respective said control disc and extends radially inwardly toward said discharge channels.

* * * * *